FIG. 1
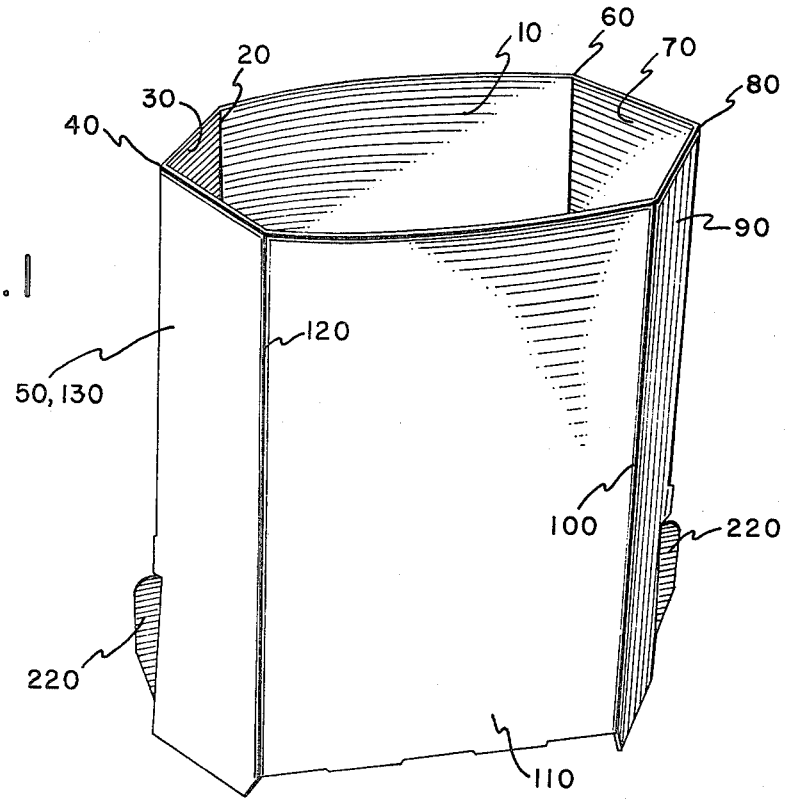
FIG. 2
FIG. 3
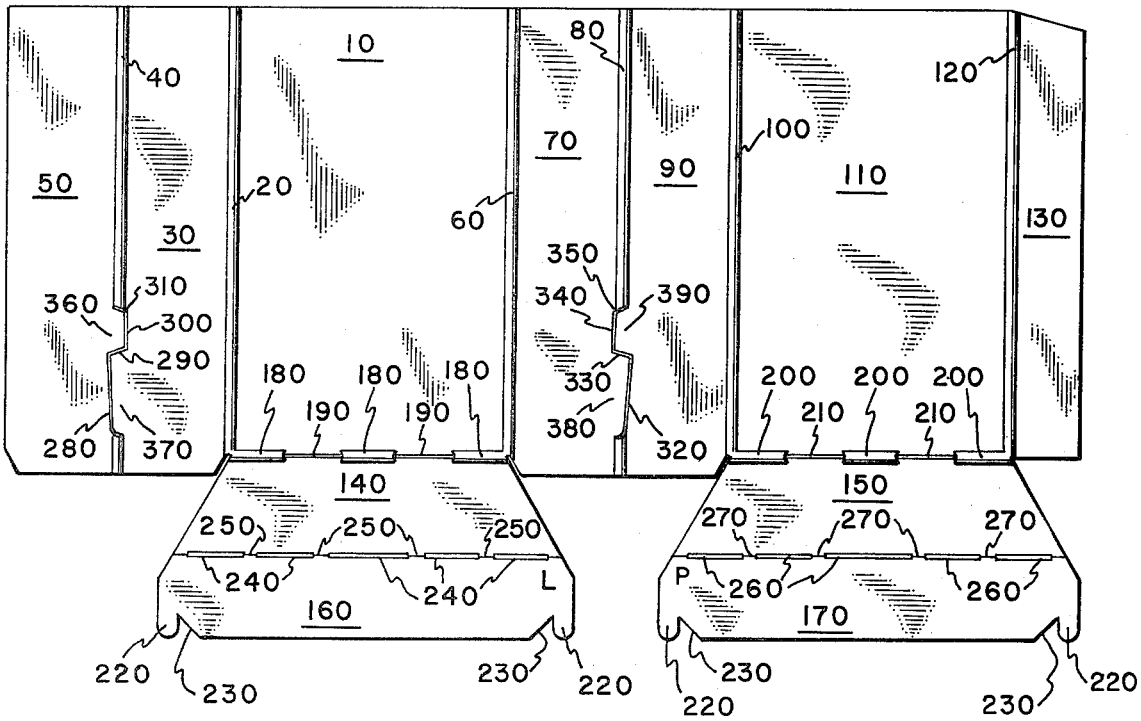

United States Patent [19]

Roccaforte

[11] 4,227,640

[45] Oct. 14, 1980

[54] SELF LOCKING TRAY AND BLANK FOR FORMING SAME

[75] Inventor: Harry I. Roccaforte, Western Springs, Ill.

[73] Assignee: Champion International Corporation, Stamford, Conn.

[21] Appl. No.: 36,742

[22] Filed: May 7, 1979

[51] Int. Cl.[3] ..... B65D 5/02; B65D 5/36

[52] U.S. Cl. ..... 229/41 C; 229/39 R; 206/173

[58] Field of Search ..... 229/39 R, 41 C; 206/173, 172

[56] References Cited

U.S. PATENT DOCUMENTS

| | | | |
|---|---|---|---|
| 902,540 | 10/1908 | Hawxhurst, Jr. | 229/41 C |
| 904,050 | 11/1908 | Crawford | 229/41 C |
| 1,720,146 | 7/1929 | Reese | 229/41 C |
| 2,593,135 | 4/1952 | Gilbert | 206/173 |
| 2,702,154 | 2/1955 | Linson | 229/39 R |
| 3,661,319 | 5/1972 | Koehler | 229/41 C X |
| 3,722,782 | 3/1973 | Collie | 229/39 R |
| 3,726,469 | 4/1973 | Koehler | 229/41 C X |
| 4,126,266 | 11/1978 | Roccaforte | 229/39 R |

*Primary Examiner*—Davis T. Moorhead
*Attorney, Agent, or Firm*—Evelyn M. Sommer

[57] ABSTRACT

A tray is disclosed, along with a planar unitary blank for forming it. The tray is open topped and includes a shelf at its bottom end, which shelf maintains the tray in an open configuration after the tray is erected. Two embodiments are taught, one with vertical sides and another with outwardly sloping sides to allow a plurality of erected trays to be stacked after erection.

7 Claims, 11 Drawing Figures

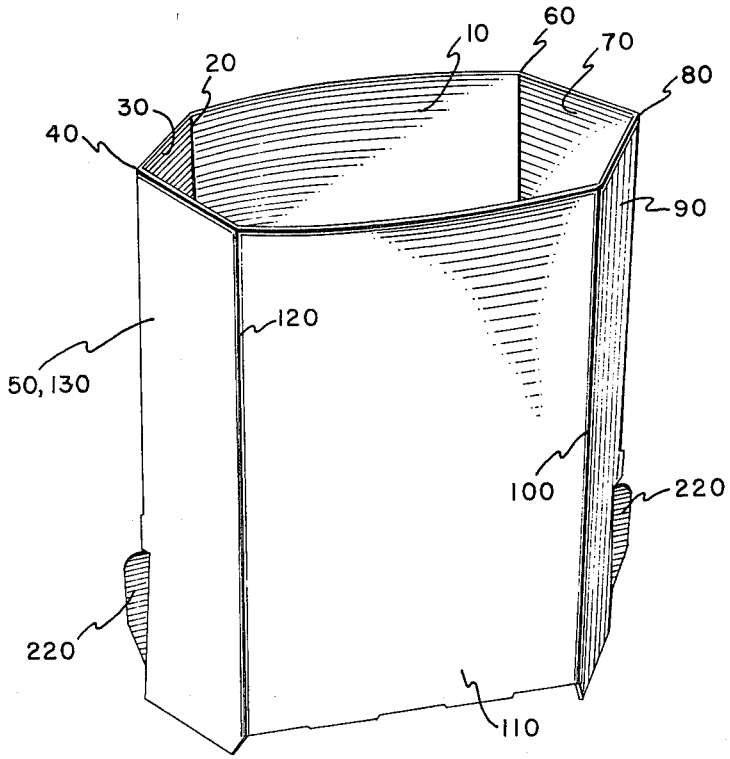

SELF LOCKING TRAY AND BLANK FOR FORMING SAME

BACKGROUND OF THE INVENTION

1. Field of the Invention

This invention relates to a tray for holding material such as french fries and a blank for forming same.

2. Description of the Prior Art

While prior art is replete with open topped trays and planar blanks for forming them, such art does not usually provide for keeping the trays open after the blanks have been assembled. This invention provides a method by which the assembled blank keeps itself locked in an open configuration after erection.

SUMMARY OF THE INVENTION

When items such as french fries are sold in a ready to eat state, they are conventionally dispensed in individual trays. Such trays can be made from unitary blanks. However, in many such trays, the blanks, after assembly, remain flat and need an additional operation to open them to a configuration in which they can receive the items to be dispensed.

In this invention, the trays are so designed that they lock themselves in an open state and do not revert to a flat state. Thus, a plurality of trays can be erected at once, to insure a supply of open trays ready for a speedy introduction of the food products to be dispensed.

Furthermore, two embodiments of the invention are taught. In one, the walls of the tray are vertical. In the other, the walls tilt outwardly to make the top of the tray wider than the bottom, so that the trays can, after erection, be stacked up vertically, one inside another.

BRIEF DESCRIPTION OF THE DRAWINGS

In the drawings:

FIG. 1 is a perspective view of the first embodiment of the invention in an erected state;

FIG. 2 is a view along the edge of the blank used to assemble the embodiment shown in FIG. 1.

FIG. 3 is a front view of the blank of FIG. 2;

DETAILED DESCRIPTION OF PREFERRED EMBODIMENTS

The two embodiments disclosed in this specification are erected in exactly the same manner from blanks which differ only in their dimensions. Therefore, corresponding elements of the blanks in both embodiments will be designated by corresponding identification numbers.

Figure 10:
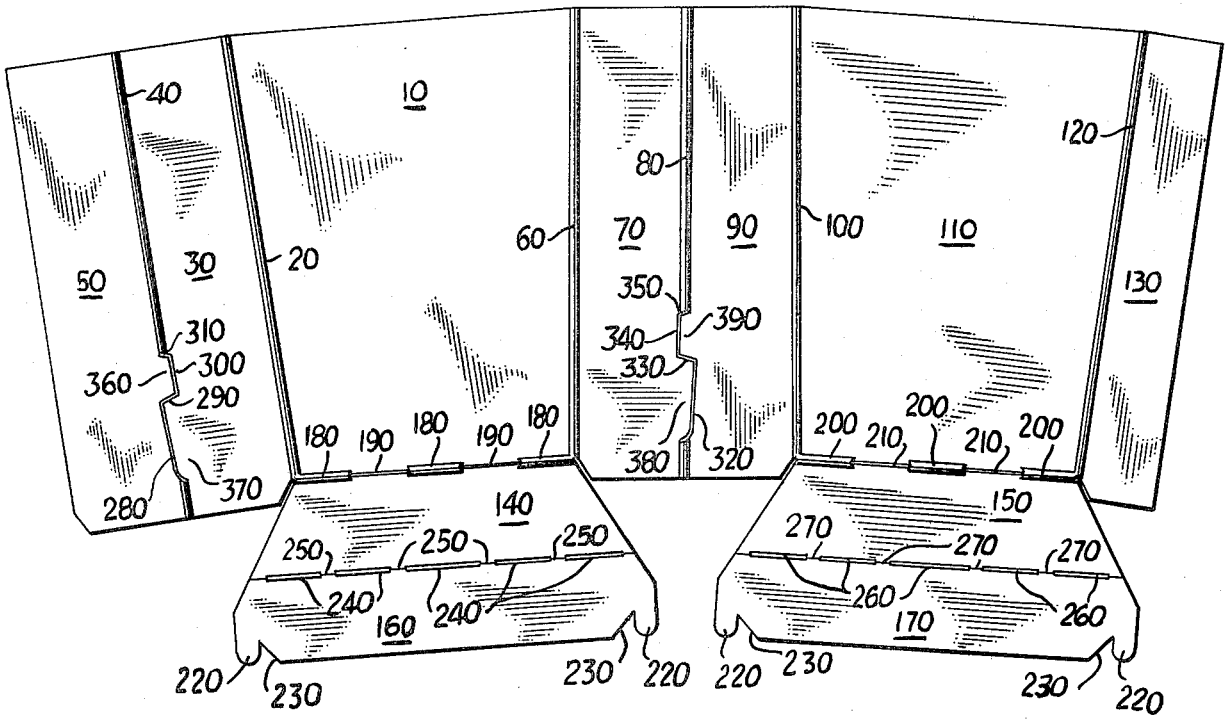
FIG. 10 is a front view of the blank used to assemble the second embodiment of the invention.

Both embodiments are constructed from planar unitary blanks as are shown in FIGS. 3 and 10. In these drawings, as in the others, thickened lines between regions represent fold lines and thin lines represent slits in the blank.

In both embodiments, region 10 denotes a rear central panel, i.e. a panel which will form the major rear surface of the tray after its erection. These regions will be vertically oriented after erection and may be vertically elongated depending upon whether a shallow tray or a deep tray is desired.

The tops of all panels described herein are not numbered, inasmuch as they do not border on any other region of the blank. However, it is specifically contemplated that a lid or hinge may be required for certain types of applications where an open-topped tray is inappropriate and the lack of specific references to the tops of the panel is not to be construed as a disclaimer of coverage for such a lid or hinge as an improvement if such be later required.

The left side of the panel 10 is defined by a first fold line 20, which also defines the right side of the left rear panel 30, which is rectangular in shape, ignoring for the moment the effect of the slits which will be later described. At this point it suffices to state that panel 30 forms one of the minor surfaces of the rear of the tray after erection.

The left side of panel 30 is defined by a second fold line 40 (ignoring, as before, the effect of the slits shown), which second fold line also defines the right side of the first left front panel 50, which has the same dimensions as the left rear panel (ignoring the slits, as before). It will be seen hereinafter that panel 50 is one of two panels adhesively secured together to form one of the minor surfaces of the front of the tray after erection.

The right side of panel 10 is defined by third fold line 60, which also forms the left side of right rear panel 70. Panel 70 takes the shape of a mirror image of panel 30, and forms one of the minor surfaces of the rear of the tray after erection.

The right side of panel 70 is defined by fourth fold line 80 (ignoring as before, the effect of the slits). Fold line 80 defines the left side of right front panel 90, which takes the shape of a mirror image of panel 50. Panel 90 forms one of the minor surfaces of the front of the tray after erection.

Fifth fold line 100 defines the right side of panel 90 and the left side of front central panel 110. Panel 110 has exactly the same shape as panel 10. It should be noted that the words "left" and "right", as used so far herein, refer to the blank and not to the finished product per se, since although panel 110 forms the major surface of the front of the tray after erection, fold line 100 appears as being the left side of panel 90 and the right side of panel 110 when the tray is erected.

Figure 4:
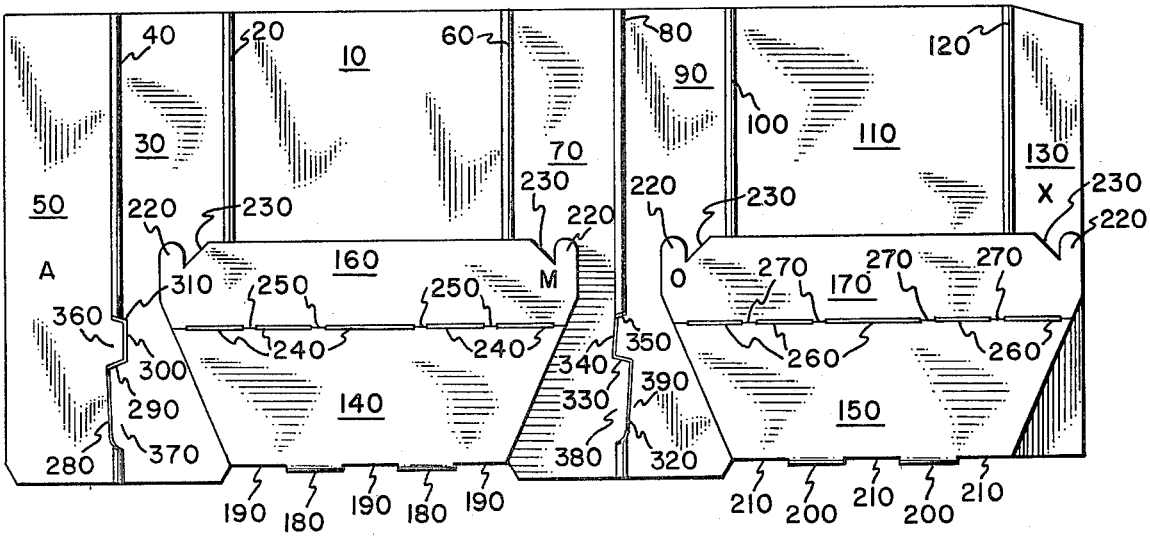
FIGS. 4, 5, 6, 8 and 9 show the progressive steps in which the blank of FIG. 3 is assembled to show the embodiment of FIG. 1.
Figure 5:
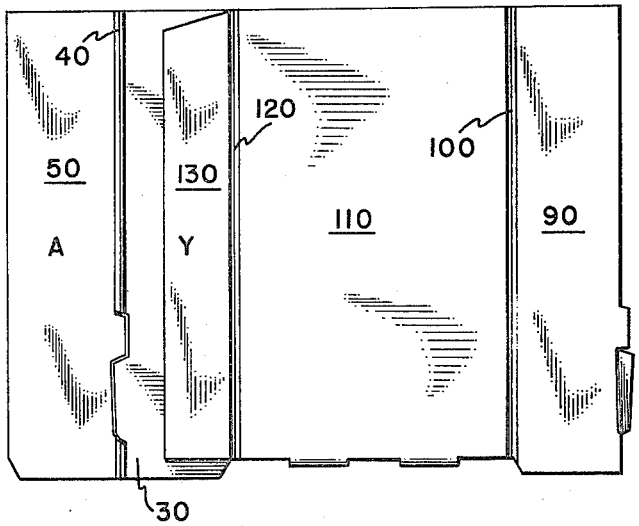
Figure 6:
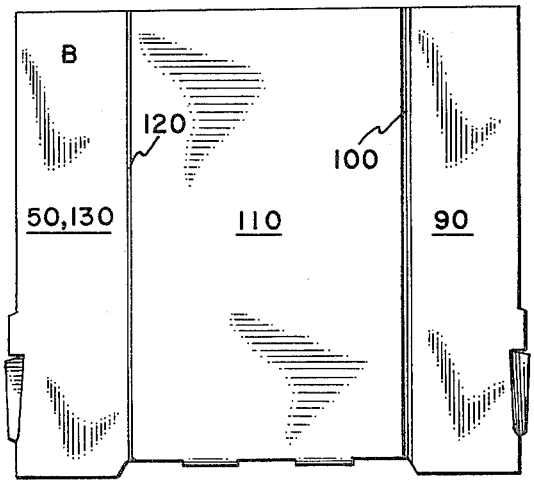

The right side of panel 110 is defined by sixth fold line 120, which also forms the left side of second left front panel 130. Panel 130 is generally rectangular and slightly smaller than panel 50. As is shown in FIGS. 4 and 5, panel 130 has an inside face marked with an X and an outside face marked with a Y. In both embodiments, the outside side is coated with adhesive to adhere to the inside face of panel 50 as is shown in FIGS. 4 and 5, with the outside face of panel 50 being marked with a B as is shown on FIG. 6.

In order to form a shelf which will prevent the contents of the tray from falling out the bottom of the tray, bottom rear panel 140, bottom front panel 150, rear mid-central panel (or rear locking panel) 160, and front mid-central panel (or front locking panel) 170 comes into play.

Panels 140 and 150 are shaped identically. Each is trapezoidal, with a long base and a short base and two like sides. The short base of panel 140 adjoins the bottom of panel 10 and is hingedly secured thereto by seventh fold line 180, which is interrupted by slits 190. In a like fashion, the corresponding base of panel 150 is hingedly secured to panel 110 by ninth fold line 200 interupted by slits 210.

Locking panels 160 and 170 are identically shaped, being horizontally elongated and having tabbed regions 220 at their ends, with notches 230 immediately adjacent the tabs towards the centers of the panels in question. Panel 160 is hingedly secured to the long base of panel 140 by eighth fold line 240 interrupted by slits 250. Panel 170 is similarly secured to panel 150 by tenth fold line 260 which is interrupted by slits 270.

The drawings show that four contiguous slits 280, 290, 300 and 310 interrupt fold line 40 and that four corresponding contiguous slits 320, 330, 340 and 350 interrupt fold line 80, forming flap 360 on panel 50, flap 370 on panel 30, flap 380 on panel 70 and flap 390 on panel 90. They also show (making particular reference to FIGS. 3 and 4) that the inner face of panel 170 is marked with an "O" and that the outer face is marked with a "P" and that likewise, corresponding surfaces of panel 160 are marked with an "L" and an "M".

Adhesive is located on face O. When the tray is erected, face O and M are matched identically and glued together after panels 140, 150, 160 and 170 are rotated upwardly as is shown in FIG. 4, and after panels 10, 30, 50, 70, 90, 110 and 130 have been folded over as per FIGS. 5 and 6 to form a flat blank suitable for final erection.

Figure 7:
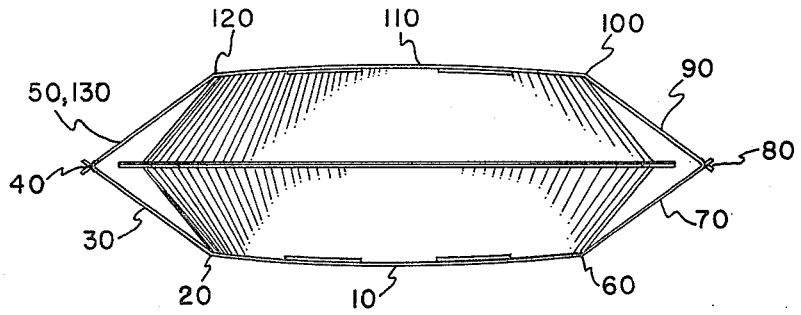
FIG. 7 is a bottom view of the first embodiment of the invention while being squeezed as is shown in FIG. 8.
Figure 8:
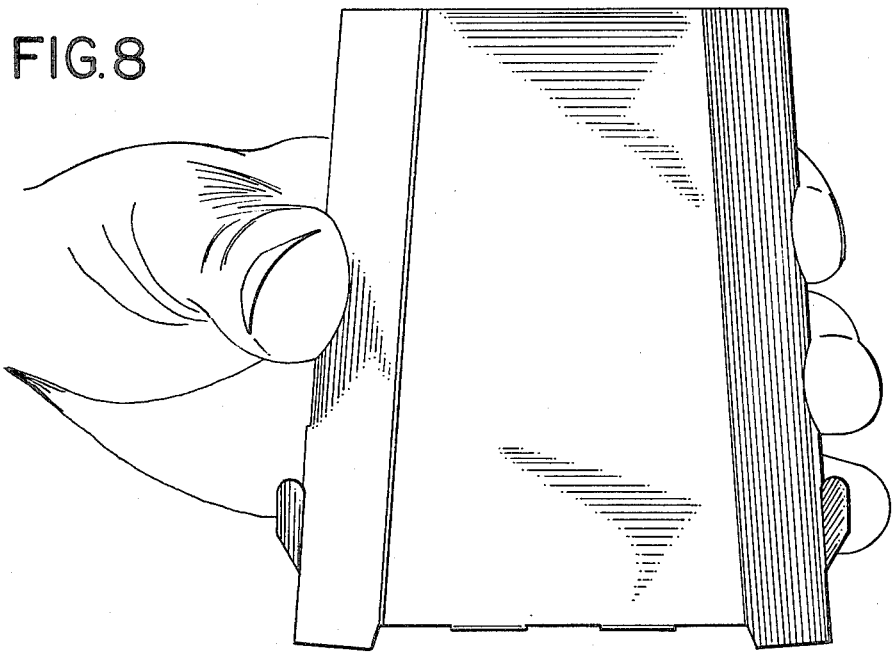
Figure 9:
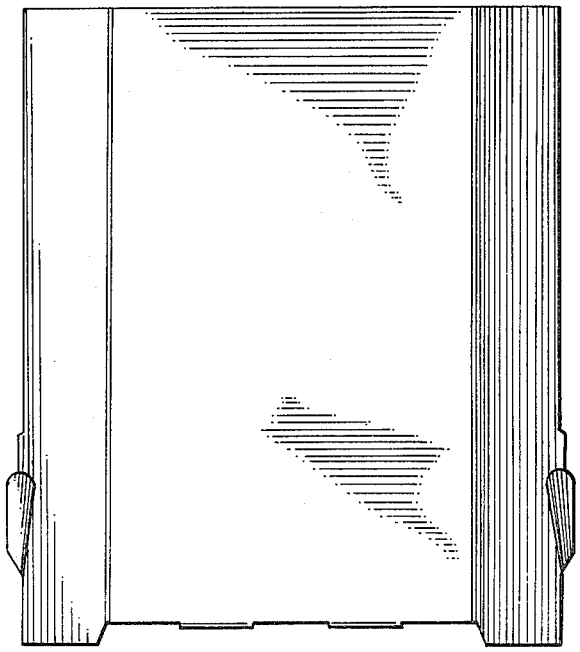

When the sides of the flat blank are manually squeezed together as is shown in FIG. 8, the tray looks like FIG. 7 when viewed from the bottom. Tabs 220 get forced into slits 280 and 320 until they pass by flaps 360 and 390. At this point, flaps 360 and 390 engage notches 230. Because these flaps are relatively small, they resist back and forth motion, and after engaging the notches 230, they hold panels 160 and 170 in tension while pulling panels 40, 50, 70, 90 and 130 inwardly and holding the top of the tray open as is shown in FIG. 1, with tabs 220 extending outwardly from the sides of the tray as shown. Additionally, because panels 160 and 170 are forced down in order to engage the notches in flaps 360 and 390, panels 140 and 150 do not lie parallel to the panels 10 and 110 but rather extend upwardly and outwardly from the center of the tray to form a bottom shelf.

Hence, the final squeezing process shown in FIG. 8 locks the tray into an open configuration, ready for the introduction of french fries or other items.

Figure 11:
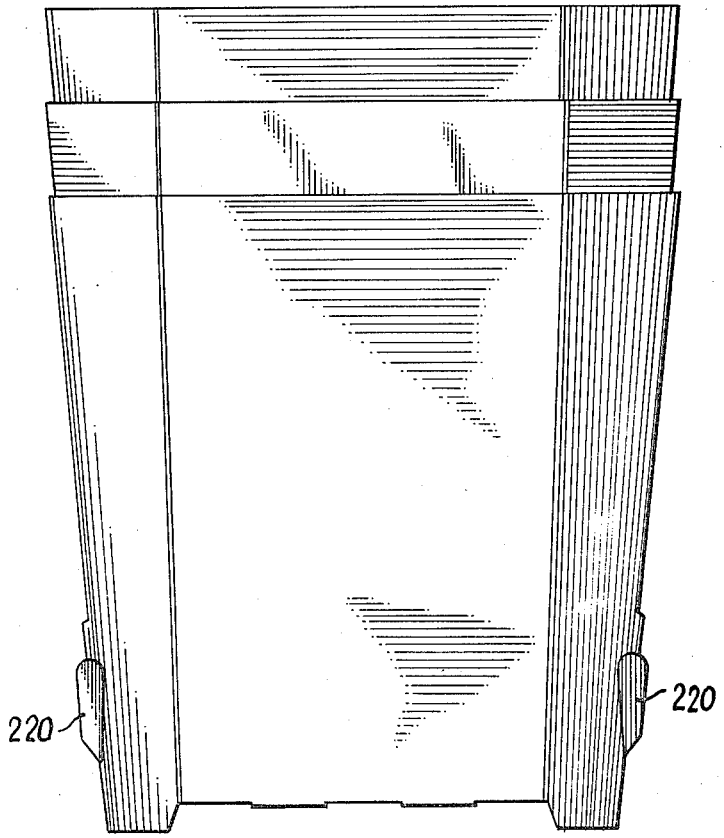
FIG. 11 shows a plurality of erected second embodiments of the invention stacked vertically, one inside another.

In the first embodiment of the invention, panels 10 and 110 are rectangular, which results in the parallelism of fold lines 20, 40, 60, 80, 100, and 120 and results in a tray with vertical sides. In the second embodiment, panels 10 and 110 are slightly wider at the top than the bottom. In this configuration, fold lines 60, 80 and 100 are parallel and fold lines 20 and 40 are parallel, but these two groups of fold lines are not parallel to each other because they are offset by the width differential between the bottoms of panels 10 and 110 and their tops. This second embodiment causes the top of the tray to be wider than the bottom of the tray when erected, and allows vertical stacking of a plurality of trays as is shown in FIG. 11.

It should finally be noted that fold lines 180 and 200 and slits 190 and 210 are raised above the bottoms of neighboring panels 30, 70, 90 and 130, in both embodiments. This causes the tray to stand on two two-edged legs formed by panels 30, 50 and 130 on the left and panels 70 and 90 on the right.

I claim:

1. A planar unitary blank for forming a self-locking tray comprising:

a rear central panel with a left side, a right side, a top and a bottom;

a left rear panel with a left side, a right side, a top and a bottom, the right side of the left rear panel being hingedly secured to the left side of the rear central panel by a first fold line;

a first left front panel with a left side, a right side, a top and a bottom, the right side of the left front panel being hingedly secured to the left side of the left rear panel by a second fold line;

a right rear panel with a left side, a right side, a top and a bottom, the left side of the right rear panel being hingedly secured to the right side of the rear central panel by a third fold line;

a right front panel with a left side, a right side, a top and a bottom, the left side of the right front panel being hingedly secured to the right side of the right rear panel by a fourth fold line;

a front central panel with a left side, a right side, a top and a bottom, the left side of the front central panel being hingedly secured to the right side of the right front panel by a fifth fold line;

a second left front panel with a left side, a right side, a top and a bottom, the left side of the second left front panel being hingedly secured to the right side of the front central panel by a sixth fold line;

a trapezoidal bottom rear panel with a short base, a long base and two sides, the short base of the bottom rear panel being hingedly secured to the bottom of the rear central panel by a horizontally elongated seventh fold line;

a horizontally elongated rear mid-central panel with a top edge, a bottom edge and two ends, the bottom edge being hingedly secured to the long base of the bottom rear panel by a horizontally elongated eighth fold line;

a trapezoidal bottom front panel with a long base, a short base and two sides, the short base of the bottom panel being hingedly secured to the bottom of the front central panel by a horizontally elongated ninth fold line; and, a horizontally elongated front mid-central panel with a top edge, a bottom edge and two ends, the bottom edge being hingedly secured to the long base of the bottom front panel by a horizontally elongated tenth fold line.

2. The blank of claim 1 wherein the ends of the mid-central panels are shaped into locking tabs and wherein the second and fourth fold lines are slitted to accommodate and secure the locking tabs.

3. The blank of claim 2 wherein the rear side of the second left front panel and the rear side of the front mid-central panel are coated with adhesive in a manner that the second left front panel will adhere to the first left front panel and the front mid-central panel will adhere to the rear mid-central panel.

4. The blank of claim 3 wherein the first left front panel, the left rear panel, the right rear panel and the right front panel are of like dimensions, the rear central panel and the front central panel are of like dimensions, the bottom rear panel and bottom front panel are of like dimensions, and the rear mid-central panel and the front mid-central panel are of like dimensions.

5. The blank of claim 4 wherein the first, second, third, fourth, fifth and sixth fold lines are parallel.

6. The blank of claim 4 wherein the widths of the tops of the rear central panel and the front central panel are greater than the widths of the bottoms of said panels, and wherein the third, fourth and fifth fold lines are parallel and the first and second fold lines are parallel.

7. A self-locking tray comprising:

opposed front and rear central panels and opposed side panels, each side panel being bifurcated to define hingedly connected front and rear members, said panels being alternately hingedly connected to form an upstanding tubular hexagonal structure, and with each side panel including a tab receiving slit and a notch engaging flap;

opposed, generally trapizoidal front and rear bottom panels, with the short base side of said trapizoidal front bottom panel being hingedly connected to the bottom edge of said front central panel, and with the short base side of the trapizoidal rear bottom panel being hingedly connected to the bottom edge of said rear central panel; and a pair of upstanding, adhesively connected, front and rear locking panels, said front and rear locking panels being respectively hingedly connected to the long base sides of said front and rear bottom panels, said front and rear locking panels being provided with notched tabs disposed at the opposed ends thereof, whereby from a substantially flat, collapsed condition, the self-locking tray may be erected to assume an open configuration by the application of pressure to said side panels wherein said bottom panels are horizontally disposed to define a bottom shelf and said notched tabs are received and engaged with the tab receiving slit and notch engaging flap of the associated side panel such that said tray remains locked in the open configuration.

* * * * *